US005606825A

United States Patent [19]

Olsen

[11] Patent Number: 5,606,825

[45] Date of Patent: Mar. 4, 1997

[54] COCKING MECHANISM FOR A MUZZLE LOADING FIREARM

[75] Inventor: Charles A. Olsen, Milford, Conn.

[73] Assignee: The Marlin Firearms Company, North Haven, Conn.

[21] Appl. No.: 500,374

[22] Filed: Jul. 10, 1995

[51] Int. Cl.[6] ..... F41A 3/72

[52] U.S. Cl. ..... 42/69.01; 89/1.3; 89/1.42; 42/51

[58] Field of Search ..... 89/1.3, 1.42; 42/51, 42/16, 17, 18, 19, 69.01, 69.02

[56] References Cited

U.S. PATENT DOCUMENTS

| | | | |
|---|---|---|---|
| 710,124 | 9/1902 | Tasker | 42/69.01 |
| 875,209 | 12/1907 | Prinke | 42/69.02 |
| 2,757,474 | 8/1956 | Williams | 42/69.01 |
| 2,816,484 | 12/1957 | Grages | 42/16 |
| 4,004,364 | 1/1977 | Chatigny | 42/69.02 |
| 5,109,622 | 5/1992 | Echeberria | 42/69.02 |

FOREIGN PATENT DOCUMENTS

| | | | |
|---|---|---|---|
| 358029 | 1/1906 | France | 42/16 |
| 959509 | 3/1950 | France | 42/16 |

*Primary Examiner*—Stephen M. Johnson
*Attorney, Agent, or Firm*—Chilton, Alix & Van Kirk

[57] ABSTRACT

A muzzle loading firearm having a tubular receiver for retaining an axially movable hammer and a cocking handle assembly for moving the hammer to a cocked position. The hammer has a first body portion having a laterally extending slot and an engagement portion for receiving and engaging the sear. The cocking handle assembly is comprised of a cocking handle block disposed in the hammer slot and a cocking handle. A cocking handle return spring biases the cocking handle assembly towards a forward position. A hammer spring biases the hammer towards the percussion cap. The hammer is cocked by moving the cocking handle assembly to a rear position against the force of the cocking handle return spring. The rear surface of the cocking handle block engages the rear surface of the hammer slot, moving the hammer to the limit of rearward travel and allowing the sear to be received by the hammer engagement portion. The cocking handle return spring and the hammer spring urge the cocking handle assembly into the forward position and the hammer into engagement with the sear upon release of the cocking handle. Upon firing, the sear releases the hammer and the hammer spring urges the hammer into engagement with the percussion cap.

25 Claims, 7 Drawing Sheets

COCKING MECHANISM FOR A MUZZLE LOADING FIREARM

BACKGROUND OF THE INVENTION

This invention relates generally to muzzle loading firearms. More particularly, the present invention relates to cocking mechanisms employed in such firearms.

Although muzzle loading rifles have been generally supplanted by modern repeater rifles, muzzle loading rifles continue to be in use and have enjoyed increasing popularity in large part because the hunting laws of numerous states provide for longer hunting seasons and/or specific seasons for hunters using muzzle loading rifles. As a result, it is desirable to provide a rifle which loads through the muzzle so as to comply with the applicable state hunting laws, but can be easily and safely loaded, primed and cocked.

Existing muzzle loading rifles have an external hammer mechanism which is cocked by manually pulling the hammer back, or an internal axially slidable hammer which is cocked by pulling backward on an external end piece extending rearwardly from the receiver of the rifle.

SUMMARY OF THE INVENTION

Briefly, the present invention in a preferred form is embodied in a firearm having a tubular receiver for retaining an axially movable hammer and a cocking assembly. A spring urges the hammer from a rearward cocked position to a forward fired position within the receiver.

The present invention provides a hammer having a forward striking portion. Rearward of the striking portion, the hammer has a first body portion having a laterally extending slot, an engagement portion for receiving and engaging the sear, and a rearward second body portion. The first and second body portions and the engagement portion define an axial bore extending from the rear surface of the hammer to the slot. The axial bore has first and second portions, the diameter of the first portion being greater than the diameter of the second portion and thereby defining an interior shoulder.

The cocking handle assembly is comprised of a cocking handle block disposed in the hammer slot and a cocking handle. The cocking handle block defines an axial bore and a transverse groove. A first end portion of the cocking handle is received in the groove. An axial notch in the first end portion is aligned with the axial bore of the cocking handle block and the second portion of a spring guide rod is inserted into the bore and notch to lock the cocking handle to the cocking handle block. The second end portion of the cocking handle extends outwardly through an orifice in the receiver. The cocking handle assembly is slidably movable between a forward position and a rearward position in the receiver.

The spring guide rod comprises first and second portions. The diameter of the first portion is greater than the diameter of the second portion thereby defining an exterior shoulder. The second portion diameter is sized to fit slidably within the hammer bore second portion, the bore of the cocking handle block, and the notch of the cocking handle first end portion. A cocking handle return spring is disposed around the first portion of the spring guide rod. The first end of the cocking handle return spring engages the spring guide rod shoulder and the second end engages the rear surface of the cocking handle block to bias the cocking handle assembly towards the forward position. A hammer spring is disposed around the spring guide rod and the cocking handle return spring.

The first end of the hammer spring engages the front wall of the receiver cap and the second end of the hammer spring engages the interior shoulder of the hammer bore to bias the hammer towards the nipple.

To cock the firearm, the cocking handle assembly is moved to the rear position. The rear surface of the cocking handle block engages the rear surface of the hammer slot to move the hammer to the limit of rearward travel in the receiver. When the hammer is at the limit of rearward travel, the sear is received by the hammer engagement portion. Releasing the cocking handle allows the cocking handle return spring to urge the cocking handle assembly into the forward position. The sear engages the hammer shoulder to hold the hammer in the cocked position against the force of the hammer spring. Upon firing, the sear releases the hammer and the hammer spring urges the striking portion of the hammer into engagement with the percussion cap installed on the nipple. The cocking handle return spring continues to bias the cocking handle assembly to the forward position so that the rear surface of the cocking handle block has clearance from the rear surface of the hammer slot.

An object of the invention is to provide a new and improved muzzle loading firearm.

Another object of the invention is to provide a new and improved muzzle loading firearm having a cocking member which is a separate structure from the hammer.

A further object of the invention is to provide a new and improved muzzle loading firearm having a cocking member which remains in position upon firing of the firearm.

Other objects and advantages of the invention will become apparent from the drawings and the specification.

BRIEF DESCRIPTION OF THE DRAWINGS

The present invention may be better understood and its numerous objects and advantages will become apparent to those skilled in the art by reference to the accompanying drawing wherein like reference numerals refer to like elements in the several figures and in which.

DETAILED DESCRIPTION OF THE PREFERRED EMBODIMENT

Figure 1:
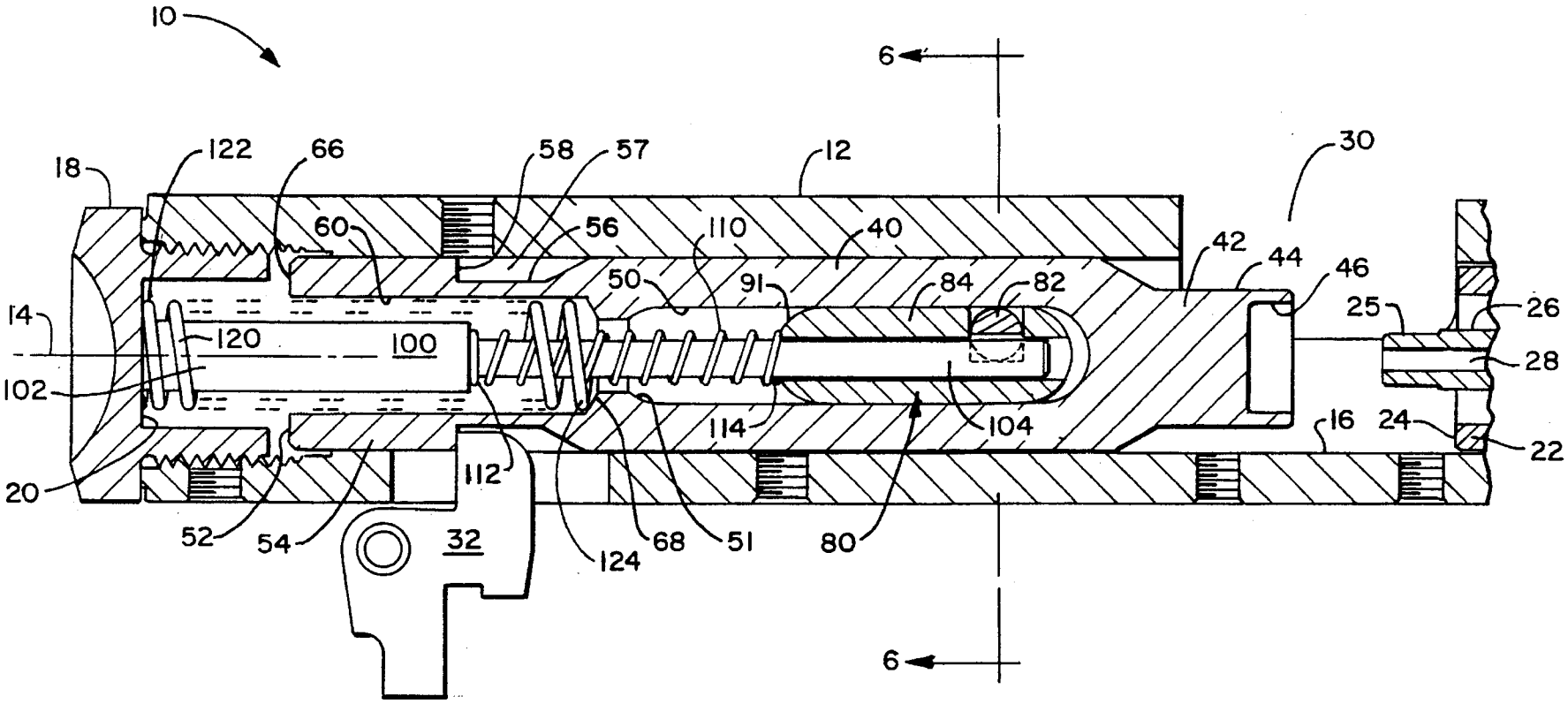
FIG. 1 is a fragmentary longitudinal sectional view of a firearm in accordance with the present invention showing the hammer in the cocked position and the cocking handle and cocking handle block in the forward position.

Referring to FIG. 1, a muzzle loading firearm, such as a firearm 10, has a barrel terminating at one end in a muzzle (not shown). Adjacent the other end of the barrel is a receiver 12 which may be integral with the barrel. The receiver 12 has a central longitudinal axis 14. The receiver is attached to the stock (not shown) by any suitable means. In a conventional manner, the rear end of the stock is adapted to be fitted against the shoulder of a user, and the forward end of the stock is adapted to be grasped by one hand for holding the firearm 10 during firing.

Figure 2:
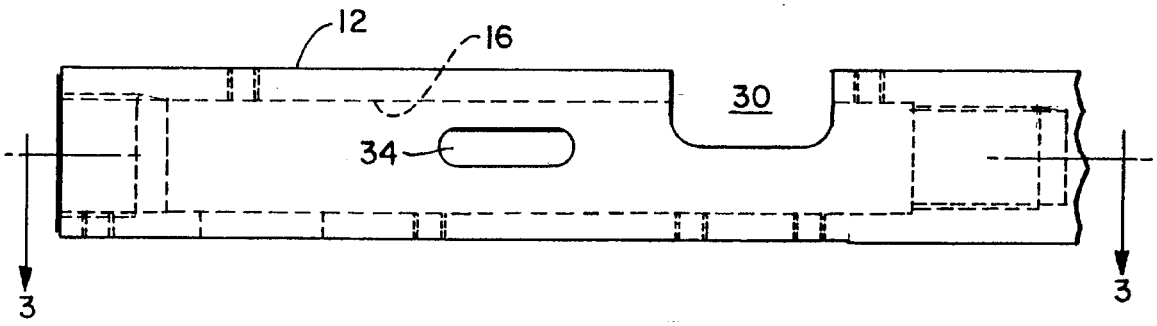
FIG. 2 is a reduced side view, partly in phantom, of the receiver of the firearm of FIG. 1.
Figure 3:
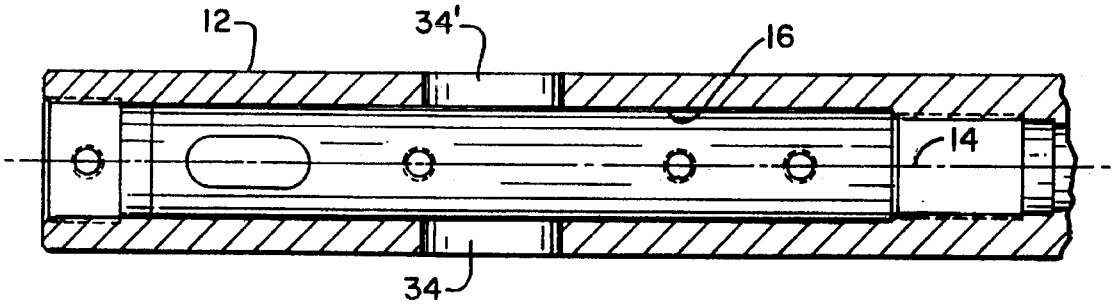
FIG. 3 is a top sectional view of the receiver taken through line 3—3 of FIG. 2.

The receiver 12 has an internal bore 16 which is coaxial with the central axis 14. Fitted at the rear end of the receiver 12 is a receiver cap 18 having a front wall 20. The receiver cap 18 is mounted to the receiver 12 by threaded connection, welding, or other suitable means. Fitted within the front end of the bore 16 is a tubular breach plug 22 having a rear wall 24. Extending from the rear wall 24 is a centrally located nipple 26. A flash hole 28 extends through the rear wall 24 and through the nipple 26. A passageway 30 provides access to the bore 16 to allow the operator to install a percussion cap 25 on the nipple 26, as shown in FIGS. 1 and 2.

Figure 4:
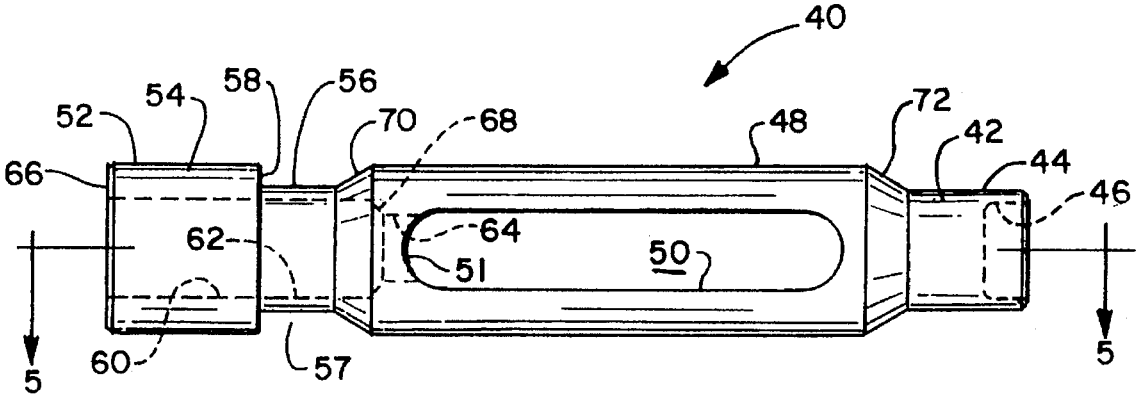
FIG. 4 is a reduced side view, partly in phantom, of the hammer of the firearm of FIG. 1.
Figure 5:
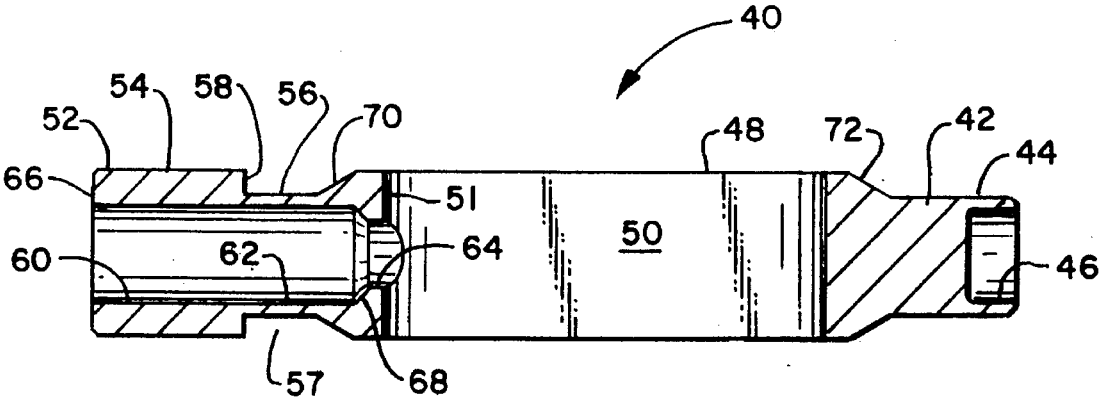
FIG. 5 is a top sectional view of the hammer taken through line 5—5 of FIG. 4.

Positioned within the receiver is a hammer 40 (FIG. 1). As shown in FIGS. 4 and 5, the forward end portion 42 of the hammer 40 comprises a cylindrical striking portion 44. The striking portion 44 defines an axial blind bore 46 for partially receiving the nipple 26. Rearward of the forward end portion 42, the hammer 40 has a first body portion 48 having a laterally extending slot 50 for receiving a cocking handle block 84 (FIG. 1).

The rear end portion 52 of the hammer 40 comprises a second body portion 54. An engagement portion 56 disposed intermediate the first and second body portions 48, 54 has a smaller outside diameter than the first and second body portions 48, 54, thereby defining an exterior shoulder 58 which may be engaged by the sear 32 to maintain the hammer 40 in a cocked position. The first body, second body and engagement portions 48, 54, 56 define an axial bore 60 extending from the rear surface 66 of the hammer 40 to the slot 50. The axial bore 60 has first and second portions 62, 64, the first portion 62 being rearward of the second portion 64. The diameter of the first portion 62 is greater than the diameter of the second portion 64 thereby defining an interior shoulder 68.

In the embodiment shown in FIGS. 4 and 5, the outside diameter of the first body portion 48 is greater than the outside diameter of both the engagement portion 56 and the striking portion 44. Tapered surfaces 70, 72 provide a smooth transition between the larger diameter portion and the smaller diameter portions, reducing residual stress. Alternatively, the transition may occur without a taper. In an alternate embodiment, the striking portion 44 and first body portion 48 may have equal diameters.

Figure 6:
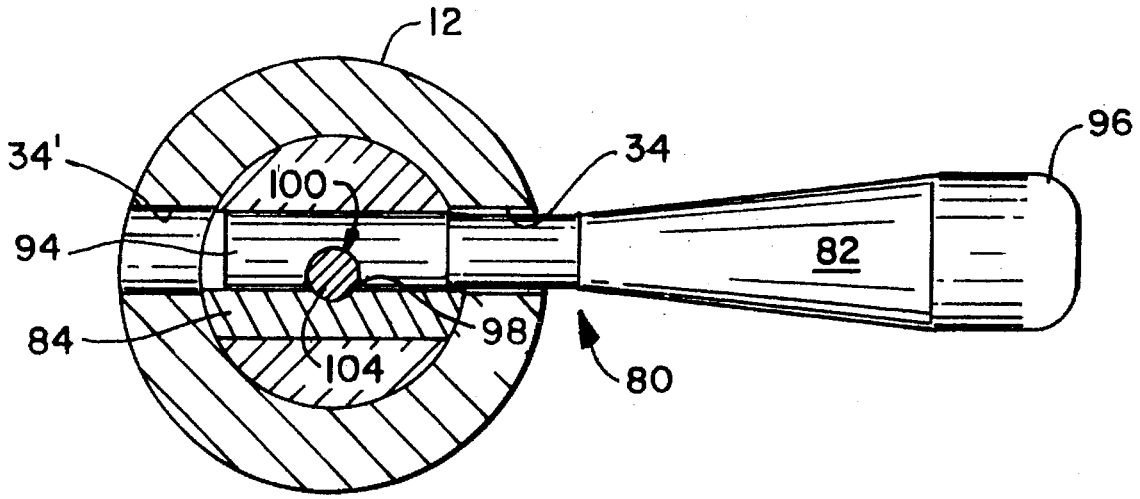
FIG. 6 is a rear cross-sectional view of the receiver, hammer, spring guide rod, cocking handle block, and cocking handle taken through line 6—6 of FIG. 1.
Figure 8:
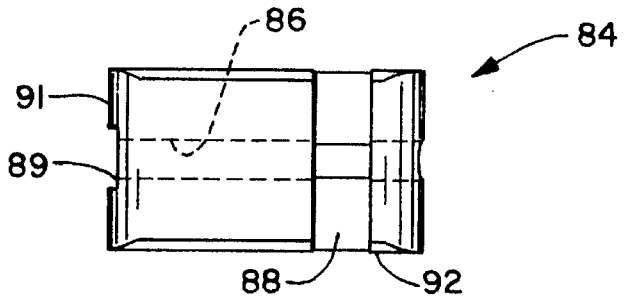
FIG. 8 is a reduced top view, partly in phantom, of the cocking handle block of the firearm of FIG. 1.
Figure 9:
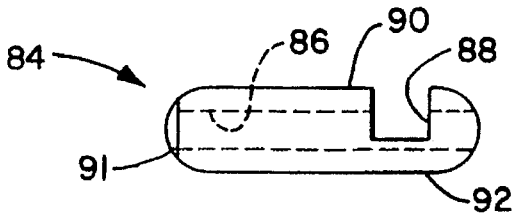
FIG. 9 is a side view, partly in phantom, of the cocking handle block of FIG. 8.
Figure 10:
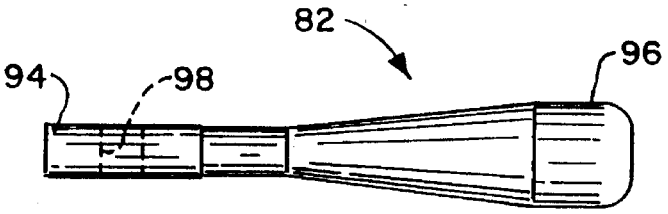
FIG. 10 is a reduced top view, partly in phantom, of the cocking handle of the firearm of FIG. 1.
Figure 11:
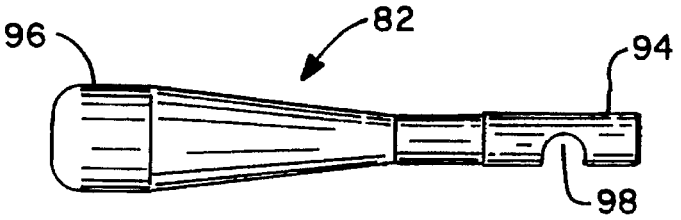
FIG. 11 is a front view, partly in phantom, of the cocking handle of FIG. 10.

The cocking handle assembly 80 is comprised of the cocking handle 2 and the cocking handle block 84. The cocking handle block 84 is disposed in the hammer slot 50 and defines an axial bore 86 and a first transverse groove 88 (FIGS. 8 and 9). In a preferred embodiment, the first groove is disposed in the upper surface 90 of the front portion 92 of the cocking handle block 84. A first end portion 94 of the cocking handle 82 (FIGS. 10 and 11) is received in the cocking handle block first groove 88. An axial notch 98 in the first end portion 94 is aligned with the axial bore 86 of the cocking handle block 84. The second portion 104 of a spring guide rod 100 is inserted into the bore 86 and notch 98 to lock the cocking handle 82 to the cocking handle block 84, as shown in FIG. 6. The second end portion 96 of the cocking handle 82 extends outwardly through an orifice 34 in the receiver 12. In a preferred embodiment, the receiver 12 is provided with two orifices 34, 34', allowing the cocking handle 82 to be positioned such that it extends from either the left-hand side or the right-hand side of the receiver 12. The cocking handle assembly 80 is slidably movable between a forward position and a rearward position in the receiver 12. The axial length of the hammer slot 50 is greater than the axial length of the cocking handle block 84 such that the cocking handle block 84 may be slidably moveable within the slot 50 by application of a longitudinal force to the cocking handle 82 (FIG. 1).

Figure 7:
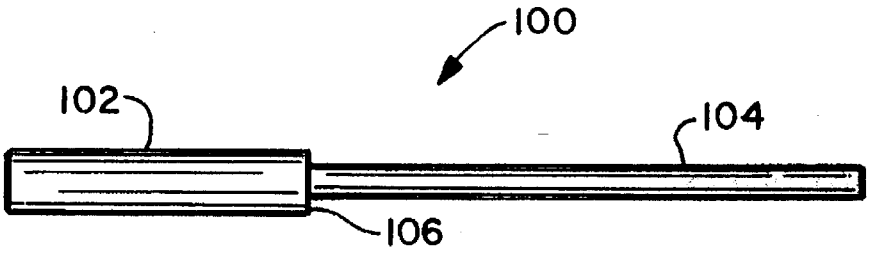
FIG. 7 is a reduced side view of the spring guide rod of the firearm of FIG. 1.
Figure 15:
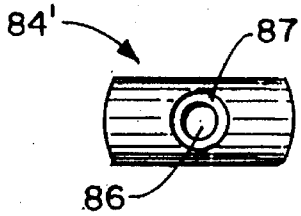
FIG. 15 is a rear view, partly in phantom, of the cocking handle block of FIG. 14.
Figure 14:
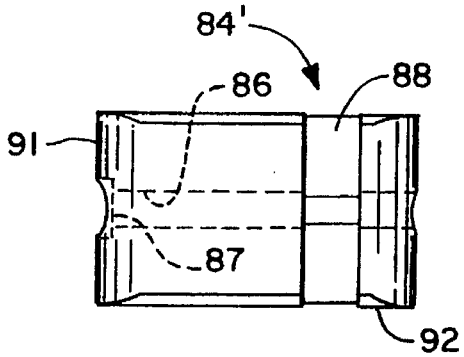
FIG. 14 is a reduced top view, partly in phantom, of an alternate embodiment of the cocking handle block of the firearm of FIG. 1.

As shown in FIG. 7, the spring guide rod 100 comprises first and second portions 102, 104. The diameter of the first portion 102 is greater than the diameter of the second portion 104 thereby defining an exterior shoulder 106. The second portion diameter is sized to fit slidably within the second portion 64 of the hammer bore 60, the bore 86 of the cocking handle block 84, and the notch 98 of the cocking handle first end portion 94. A cocking handle return spring 110 is disposed around the second portion 104 of the spring guide rod 100. The outer diameter of the cocking handle return spring 110 is sized to fit slidably within the second portion 64 of the hammer bore 60. The first end 112 of the cocking handle return spring 110 engages the spring guide rod shoulder 106 and the second end 114 engages the rear surface 91 of the cocking handle block 84. The cocking handle return spring 110 biases the cocking handle assembly 80 towards the forward position. In a preferred embodiment, the rear surface 91 of the cocking handle block 84 has a blind bore 87, as shown in FIGS. 14 and 15, for receiving the second end 114 of the cocking handle return spring 110. Alternatively, the cocking handle block 84 may have a second transverse groove 89 for receiving the cocking handle return spring 110 as shown in FIG. 8. A hammer spring 120 is disposed around the spring guide rod 100. A first end 122 of the hammer spring 120 engages the front wall 20 of the receiver cap 18. The second end 124 of the hammer spring 120 engages the interior shoulder 68 of the hammer bore 60. The hammer spring 120 biases the hammer 40 towards the breech plug 22.

Figure 12A:
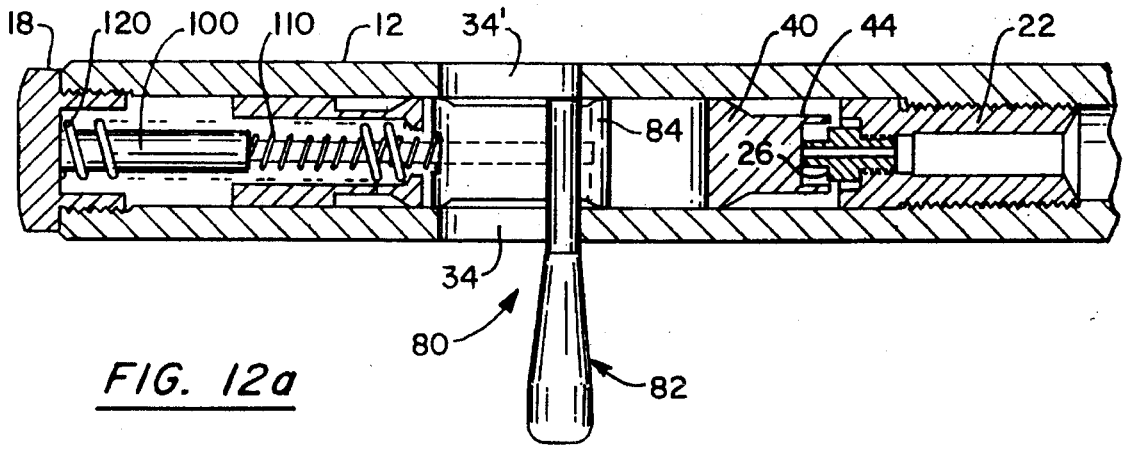
FIGS. 12*a*, 12*b*, and 12*c* are reduced top longitudinal sectional views of the firearm of FIG. 1 showing the hammer in the fired position and cocking handle and cocking handle block in a rear position relative to the hammer in FIG. 12*a*, the hammer, cocking handle and cocking handle block in the rear position relative to the receiver in FIG. 12*b*, and the hammer in a cocked position and the cocking handle and cocking handle block in a forward position relative to the hammer in FIG. 12*c;*

The hammer 40 is shown in the fired position in FIG. 12*a*. The hammer spring 120 biases the hammer 40 so that the striking portion 44 engages the nipple 26. The cocking handle return spring 110 biases the cocking handle assembly 80 to the forward position. In a preferred embodiment, the rear surface 91 of the cocking handle block 84 is immediately adjacent the rear surface 51 of the hammer slot 50. Alternatively, the rear surface 91 of the cocking handle block 84 may touch the rear surface 51 of the hammer slot 50.

Figure 12B:
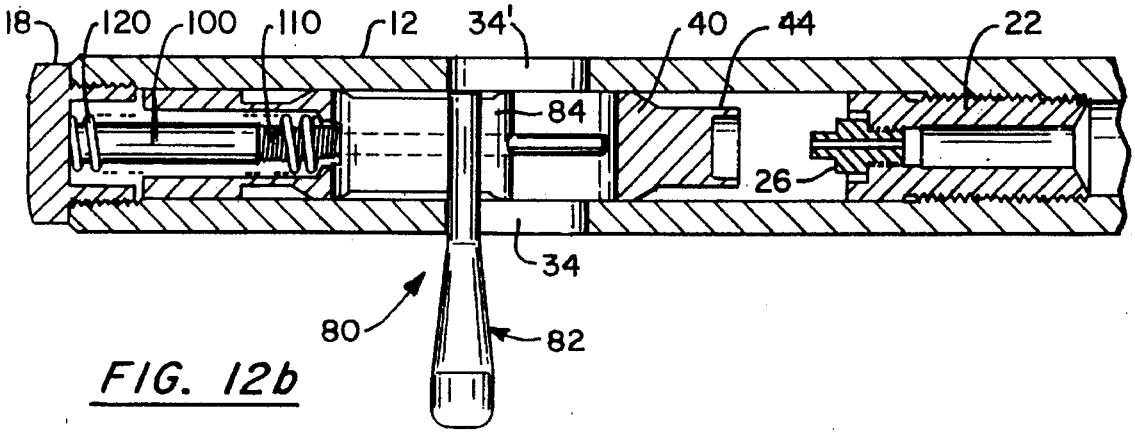
Figure 12C:
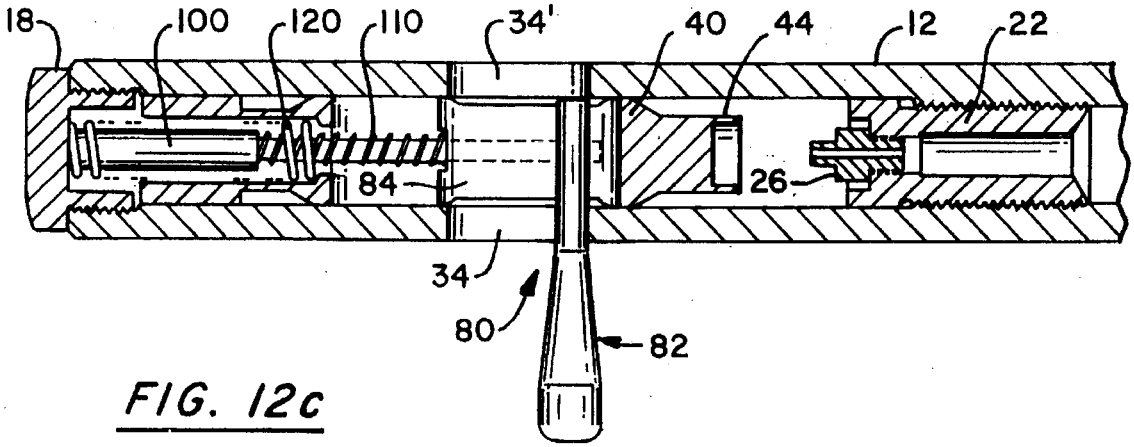
Figure 13:
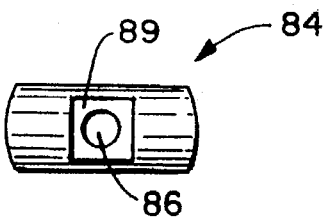
FIG. 13 is a rear view, partly in phantom, of the cocking handle block of FIG. 8.

To cock the firearm 10, the cocking handle assembly 80 is moved to the rear position, as shown in FIG. 12*b*. The rear surface 91 of the cocking handle block 84 engages the rear surface 51 of the hammer slot 50 to move the hammer 40 to the limit of rearward travel in the receiver 12. When the hammer 40 is at the limit of rearward travel, the sear 32 is received by the groove 57 defined by the hammer engagement portion 56. Releasing the cocking handle 82 allows the cocking handle return spring 110 to urge the cocking handle assembly 80 to the forward position, as shown in FIG. 12*c*. The hammer spring 120 urges the hammer 40 forward such that the sear 32 engages the hammer shoulder 58 to hold the hammer 40 in the cocked position against the force of the hammer spring 120.

Upon firing, the sear 32 releases the hammer 40 and the hammer spring 120 urges the hammer 40 forward such that the striking portion 44 of the hammer 40 strikes the percussion cap installed on the nipple 26. The cocking handle return spring 110 continues to bias the cocking handle assembly 80, maintaining the cocking handle assembly 80 in the forward position.

It will be appreciated that the cocking handle return spring 110 biases the cocking handle assembly 80 to the forward position at all times. The operator must overcome the biasing force to cock the rifle 10. Therefore, the cocking handle block 84 is not in contact with the rear surface 51 of the hammer slot 50 unless the rifle 10 is being cocked.

Figure 16:
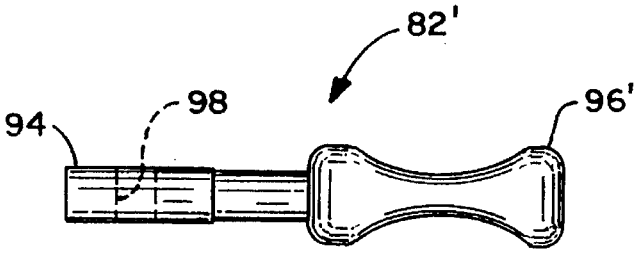
FIG. 16 is a reduced top view, partly in phantom, of an alternate embodiment of the cocking handle of the firearm of FIG. 1.
Figure 17:
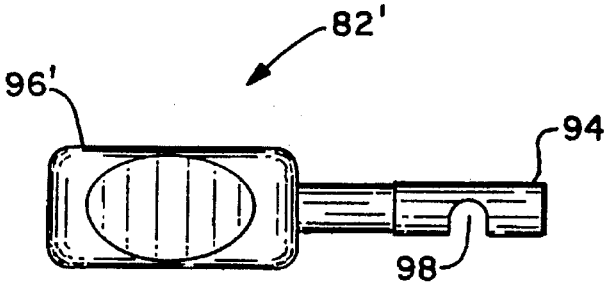
FIG. 17 is a front view of the cocking handle of FIG. 16.

It will be further appreciated that the cocking handle 82 may have a variety of configurations for reasons of aesthetics and utility. For example, an alternate embodiment of the cocking handle 82' is shown in FIGS. 16 and 17. Not only does the second end portion 96' present a different appearance, such configuration may provide a handle that is easier to grasp for some operators.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A firearm comprising:

a receiver having an outer wall defining a central axis and an inner axial bore, said outer wall defining aperture means opening into said bore;

a hammer axially movable within said receiver from a first cocked position to a second fired position, said hammer comprising opposite first and second end portions and a first body portion disposed intermediate said first and second end portions, said first body portion defining slot means comprising opposite first and second ends defining first and second surfaces;

first spring means for biasing said hammer from said cocked position to said fired position; and cocking means comprising first and second portions, said first portion axially movable within said slot means of said hammer, said second portion extending outwardly through said aperture means of said receiver and being axially movable within said aperture means, said cocking means being axially movable from a first position to a second position;

wherein said first portion of said cocking means engages said first surface of said slot means when said cocking means is moved from said first position to said second position whereby said cocking means moves said hammer to said cocked position, said cocking means returning to said first position after said rifle has been cocked.

2. The firearm of claim 1 further comprising second spring means for biasing said cocking means to said first position.

3. The firearm of claim 2 further comprising positioning means axially disposed in said second spring means for positioning said second spring means on said cocking means.

4. The firearm of claim 3 wherein said second portion of said cocking means comprises a cocking handle having an axially extending groove and said first portion of said cocking means comprises a cocking handle block having an axially extending bore for receiving said positioning means wherein said cocking means is axially movable along said positioning means.

5. The firearm of claim 1 further comprising a receiver cap and wherein said first end portion of said hammer comprises means defining an exterior shoulder.

6. The firearm of claim 5 wherein said first end portion and said first body portion of said hammer comprise an axially extending bore comprising first and second portions, each of said portions having a diameter wherein said diameter of said first portion is greater than said diameter of said second portion thereby defining an interior shoulder.

7. The firearm of claim 6 wherein said first spring means comprises first and second opposite ends wherein said first end engages said receiver cap and said second end engages said interior shoulder.

8. The firearm of claim 5 further comprising second spring means for biasing said cocking means to said first position.

9. The firearm of claim 8 further comprising positioning means axially disposed in said second spring means for positioning said second spring means on said cocking means.

10. The firearm of claim 9 wherein said positioning means and said second spring means are axially disposed in said first spring means wherein said hammer and said cocking means are axially movable along said positioning means.

11. The firearm of claim 1 wherein said second portion of said cocking means comprises a cocking handle having opposite first and second end portions wherein said first end portion extends outwardly from said receiver.

12. The firearm of claim 11 wherein said first portion of said cocking means comprises a cocking handle block having groove means for receiving said second end portion of said cocking handle.

13. The firearm of claim 12 further comprising retainer means for retaining said cocking handle in said groove of said cocking handle block.

14. The firearm of claim 1 wherein said first body portion of said hammer comprises means defining an interior shoulder.

15. The firearm of claim 14 wherein said first end portion of said hammer comprises first and second segments wherein said second segment is intermediate said first segment and said first body portion, each of said segments having an outside diameter wherein at least a portion of said outside diameter of said second segment is smaller than said outside diameter of said first segment thereby defining an exterior shoulder.

16. The firearm of claim 15 further comprising sear means engageable with said exterior shoulder for maintaining said hammer in said cocked position.

17. The firearm of claim 1 wherein said second end portion of said hammer defines an axial blind bore.

18. The firearm of claim 1 wherein said aperture means comprises first and second apertures.

19. A firearm comprising:

a receiver having an outer wall defining a central axis and an inner axial bore, said outer wall defining aperture means opening into said bore;

a hammer axially movable within said receiver from a first cocked position to a second fired position, said hammer comprising opposite first and second end portions and a first body portion disposed intermediate said first and second end portions, said first body portion defining slot means comprising opposite first and second ends defining first and second surfaces;

first spring means for biasing said hammer from said cocked position to said fired position;

cocking means comprising a cocking handle and cocking handle block, said cocking handle block being axially movable within said slot means of said hammer, said cocking handle extending outwardly through said aperture means of said receiver and being axially movable within said aperture means, said cocking means being axially movable from a first position to a second position; and second spring means for biasing said cocking means to said first position;

wherein said cocking handle block engages said first surface of said slot means when said cocking means is moved from said first position to said second position whereby said cocking means moves said hammer to said cocked position and wherein said second spring means urges said cocking means to said first position upon release of said cocking handle.

20. The firearm of claim 19 further comprising a receiver cap disposed on a first end of said receiver and wherein said first spring means comprises first and second opposite ends and said first end portion and said first body portion of said hammer comprise an axially extending bore comprising first and second portions, each of said portions having a diameter wherein said diameter of said first portion is greater than said diameter of said second portion thereby defining a shoulder, wherein said first end of said first spring means engages said receiver cap and said second end of said first spring means engages said shoulder.

21. The firearm of claim 19 further comprising positioning means axially disposed in said second spring means for positioning said second spring means on said cocking means, said positioning means comprising first and second portions, each of said portions having an outside diameter, said diameter of said first portion being greater than said diameter of said second portion thereby defining a shoulder wherein said second portion is axially disposed in said second spring means, a first end of said second spring means engages said shoulder and a second end of said second spring means engages said cocking handle block.

22. The firearm of claim 21 wherein said positioning means and said second spring means are axially disposed in said first spring means and wherein said cocking handle comprises an axially extending groove and said cocking handle block comprises an axially extending bore for receiving said positioning means, wherein said hammer and said cocking means are axially movable along said positioning means.

23. The firearm of claim 19 further comprising sear means and wherein said first end portion of said hammer comprises first and second segments wherein said second segment is intermediate said first segment and said first body portion, each of said segments having an outside diameter wherein at least a portion of said outside diameter of said second segment is smaller than said outside diameter of said first segment thereby defining a shoulder, said sear means being engageable with said shoulder for maintaining said hammer in said cocked position.

24. The firearm of claim 19 wherein said cocking handle comprises opposite first and second end portions and said cocking handle block comprises groove means for receiving said second end portion of said cocking handle, said first end portion of said cocking handle extending outwardly from said receiver, the firearm further comprising retainer means for retaining said cocking handle in said groove of said cocking handle block.

25. A firearm comprising:

a receiver having an outer wall defining a central axis and an inner axial bore, said outer wall defining aperture means opening into said bore;

a hammer axially movable within said receiver from a first cocked position to a second fired position, said hammer comprising slot means defining a slot;

sear means for releasably holding said hammer in said first cocked position;

first spring means for biasing said hammer from said cocked position to said fired position;

cocking means comprising first and second portions, said first portion axially movable within said slot means of said hammer, said second portion extending outwardly through said aperture means of said receiver and being axially movable within said aperture means, said cocking means being axially movable from a first position to a second position; and second spring means for biasing said cocking means to said first position;

wherein said cocking means is movable from said first position to said second position to move said hammer to said cocked position and said second spring means forces said cocking means to return to said first position after said rifle has been cocked.

* * * * *